US010538921B2

(12) United States Patent
Brochu

(10) Patent No.: US 10,538,921 B2
(45) Date of Patent: Jan. 21, 2020

(54) RAIN GUTTER COVER AND RAIN GUTTER INCLUDING SAME

(71) Applicant: Stéphane Brochu, Saint-Romuald (CA)

(72) Inventor: Stéphane Brochu, Saint-Romuald (CA)

( * ) Notice: Subject to any disclaimer, the term of this patent is extended or adjusted under 35 U.S.C. 154(b) by 0 days.

(21) Appl. No.: 15/807,412

(22) Filed: Nov. 8, 2017

(65) Prior Publication Data

US 2018/0127981 A1 May 10, 2018

Related U.S. Application Data

(60) Provisional application No. 62/418,989, filed on Nov. 8, 2016.

(51) Int. Cl.
*E04D 13/076* (2006.01)

(52) U.S. Cl.
CPC ..... *E04D 13/076* (2013.01)

(58) Field of Classification Search
None
See application file for complete search history.

(56) References Cited

U.S. PATENT DOCUMENTS 1,105,390 A * 7/1914 Whendon ..... E04D 13/0725 248/48.2
3,053,393 A * 9/1962 McLean ..... E04D 13/076 210/474
3,053,491 A * 9/1962 Ramser ..... E04D 13/0725 248/48.2
3,189,304 A * 6/1965 Vranyosovics ..... E04D 13/0725 248/48.2
4,043,527 A * 8/1977 Franzmeier ..... E04D 13/0725 248/65
4,294,422 A * 10/1981 Odekirk ..... E04D 13/0725 248/216.1
5,251,410 A * 10/1993 Carey ..... E04D 13/076 52/12
5,375,379 A * 12/1994 Meckstroth ..... E04D 13/076 210/474

(Continued)

FOREIGN PATENT DOCUMENTS

CA 2 305 159 A1 10/2001
CA 2 405 756 A1 3/2004

(Continued)

*Primary Examiner* — Kyle J. Walraed-Sullivan
(74) *Attorney, Agent, or Firm* — Merchant & Gould P.C.

(57) ABSTRACT

A gutter cover, the central portion of which comprises a plurality of spaced-apart deflectable fastener-receiving flaps hingedly connected at a junction with the rear portion, the deflectable fastener receiving flaps being pivoted into the trough, below the adjacent section of the central portion, upon insertion of a mechanical fastener therein and into the rear wall of the gutter to secure the gutter to the supporting surface. The rear portion of the cover may also comprise a fastener-abutment extending in the trough, below the central portion, and defining an oblique angle with the rear wall of the gutter, when the gutter cover is engaged with the gutter. The fastener abutment and the rear wall of the gutter are configured to receive a mechanical fastener therein to secure the gutter to a wall, the fastener abutment maintains the mechanical fastener in an oblique angle with the rear wall of the gutter.

14 Claims, 10 Drawing Sheets

(56) References Cited

U.S. PATENT DOCUMENTS 5,388,377 A * 2/1995 Faulkner ..... E04D 13/0725 52/11
5,966,875 A * 10/1999 Kuhns ..... E04D 13/076 52/12
6,073,398 A * 6/2000 Williams ..... E04D 13/076 52/11
6,161,338 A * 12/2000 Kuhns ..... E04D 13/076 210/474
6,209,826 B1 * 4/2001 Pratt, Jr. ..... E04D 13/0725 248/231.9
6,412,228 B1 * 7/2002 Meckstroth ..... E04D 13/076 210/474
6,427,388 B1 8/2002 Brochu
6,543,729 B1 * 4/2003 Ylonen ..... E04D 13/0725 248/48.1
6,786,008 B2 9/2004 Brochu
D523,538 S 6/2006 Brochu
D558,309 S 12/2007 Gregg
D569,011 S 8/2008 Brochu
7,494,095 B2 * 2/2009 Walker ..... E04D 13/0725 248/48.2
7,658,036 B2 2/2010 Banks et al.
7,765,743 B2 8/2010 Guilford
7,861,980 B1 * 1/2011 Verbrugge ..... E04D 13/076 248/48.1
8,037,641 B2 10/2011 Gerig
8,191,315 B1 6/2012 Brochu
8,322,082 B2 12/2012 Neumann
8,375,644 B2 2/2013 Robins
8,434,269 B1 5/2013 Brochu
8,479,454 B2 7/2013 Lenney et al.
8,578,658 B2 * 11/2013 Snell ..... E04D 13/076 210/474
D723,671 S 3/2015 Brochu
9,010,029 B2 4/2015 Higginbotham
9,212,490 B1 * 12/2015 Ealer, Sr. ..... E04D 13/076
2003/0110712 A1 6/2003 Brochu
2004/0118052 A1 6/2004 Brochu
2004/0182014 A1 9/2004 Brochu
2004/0244302 A1 12/2004 Neumann
2005/0028452 A1 2/2005 Brochu
2005/0115160 A1 6/2005 Brochu
2005/0172565 A1 * 8/2005 Riley ..... E04D 13/076 52/12
2005/0193642 A1 9/2005 Brochu
2005/0193671 A1 9/2005 Brochu
2005/0223657 A1 10/2005 Brochu
2005/0274081 A1 * 12/2005 Welty ..... E04D 13/076 52/120
2005/0279036 A1 12/2005 Brochu
2006/0037255 A1 2/2006 Brochu
2006/0101722 A1 * 5/2006 Ealer, Sr. ..... E04D 13/076 52/12
2006/0123710 A1 6/2006 Lenney et al.
2006/0265968 A1 * 11/2006 Lowrie, III ..... E04D 13/076 52/11
2006/0283097 A1 12/2006 Gregg
2007/0017162 A1 * 1/2007 Staub ..... E04D 13/076 52/11
2007/0095995 A1 * 5/2007 Higgins ..... E04D 13/0725 248/300
2007/0167130 A1 7/2007 Brochu
2007/0169423 A1 7/2007 Brochu
2007/0277446 A1 * 12/2007 Dowling ..... E04D 13/076 52/11
2008/0000169 A1 * 1/2008 Handley ..... E04D 13/076 52/12
2008/0163561 A1 7/2008 Lenney et al.
2008/0190039 A1 8/2008 Brochu
2008/0289263 A1 11/2008 Brochu
2009/0013612 A1 1/2009 Brochu
2009/0056234 A1 3/2009 Brochu
2009/0108144 A1 4/2009 Brochu
2010/0287846 A1 11/2010 Lenney
2011/0056145 A1 3/2011 Lenney et al.
2011/0067318 A1 3/2011 Lenney et al.
2011/0126477 A1 * 6/2011 Hum ..... E04D 13/076 52/12
2012/0073212 A1 * 3/2012 Wootton ..... E04D 13/064 52/12
2012/0151849 A1 6/2012 Brochu
2014/0069028 A1 3/2014 Lenney
2014/0196400 A1 * 7/2014 Bell ..... E04D 13/0725 52/705
2014/0215929 A1 8/2014 Lenney
2015/0040488 A1 2/2015 Lenney
2015/0143756 A1 5/2015 Higginbotham
2015/0225959 A1 8/2015 Lenney
2016/0168857 A1 6/2016 Neumann
2016/0369512 A1 12/2016 Lenney
2017/0058531 A1 3/2017 Brochu
2017/0204611 A1 7/2017 Brochu

FOREIGN PATENT DOCUMENTS

CA 2 458 005 A1 8/2005
CA 2 458 006 A1 8/2005
CA 2 460 429 A1 9/2005
CA 2 541 186 A1 7/2007
CA 2 593 808 A1 1/2009
CA 2 608 530 A1 4/2009
CA 2 727 844 A1 7/2012
CA 2 747 513 A1 1/2013
CA 2 783 834 A1 8/2013
CA 2 775 864 A1 11/2013
CA 2 863 023 A1 3/2016
CA 2 747 704 C 4/2016
CA 2 907 280 A1 2/2017
CA 2 919 709 A1 8/2017
EP 1 449 980 A1 8/2004
EP 1 627 974 A2 2/2006
EP 2 159 342 A1 3/2010
EP 2 177 685 A1 4/2010
GB 2 481 033 A 12/2011
WO 2007/100320 A1 9/2007
WO 2008/134845 A1 11/2008

* cited by examiner

RAIN GUTTER COVER AND RAIN GUTTER INCLUDING SAME

CROSS REFERENCE TO A RELATED APPLICATION

The present patent application claims the priority of U.S. provisional application Ser. No. 62/418,989, filed Nov. 8, 2016, the content of which is incorporated herein in its entirety.

TECHNICAL FIELD

The technical field generally relates to a gutter cover that prevents debris from entering a gutter trough. It also relates to a gutter system including the gutter and gutter cover and to a rain gutter including a gutter cover. The gutter cover is configured to be engageable with a rain gutter and securable to a supporting surface, such as a wall, securing simultaneously the rain gutter to the supporting surface.

SUMMARY

In accordance with a first aspect of the invention, there is provided a gutter cover engageable with a gutter superposable to a supporting surface, the gutter comprising a front wall, a bottom wall and a rear wall defining a trough with an open top, the gutter cover being engageable with the gutter to at least partially cover the open top, the gutter cover comprising: a front portion engageable with the front wall of the gutter, a rear portion engageable with the rear wall of the gutter, and a perforated central portion extending between the front portion and the rear portion, the central portion comprising a plurality of spaced-apart deflectable fastener-receiving flaps hingedly connected at a junction with the rear portion, the deflectable fastener receiving flaps being pivoted into the trough, below the adjacent section of the central portion, upon insertion of a mechanical fastener therein and into the rear wall of the gutter to secure the gutter to the supporting surface.

According to a second aspect, the invention provides a gutter cover in combination with a gutter superposable to a supporting surface, the gutter comprising a front wall, a bottom wall, and a rear wall defining a trough with an open top, the gutter cover comprising: a front portion engageable with the front wall of the gutter, a rear portion engageable with the rear wall of the gutter, a perforated central portion extending between the front portion and the rear portion; the rear portion comprising a fastener abutment extending in the trough, below an adjacent section of the central portion, and defining an oblique angle with the rear wall of the gutter, when the gutter cover is engaged with the gutter to at least partially cover the open top; the fastener abutment and the rear wall of the gutter being configured to receive a mechanical fastener therein to secure the gutter to the supporting surface, the fastener abutment maintaining the oblique angle with the rear wall of the gutter upon insertion of the mechanical fastener therethrough.

Detailed Description

DESCRIPTION OF PARTICULAR EMBODIMENTS

Figure 1:
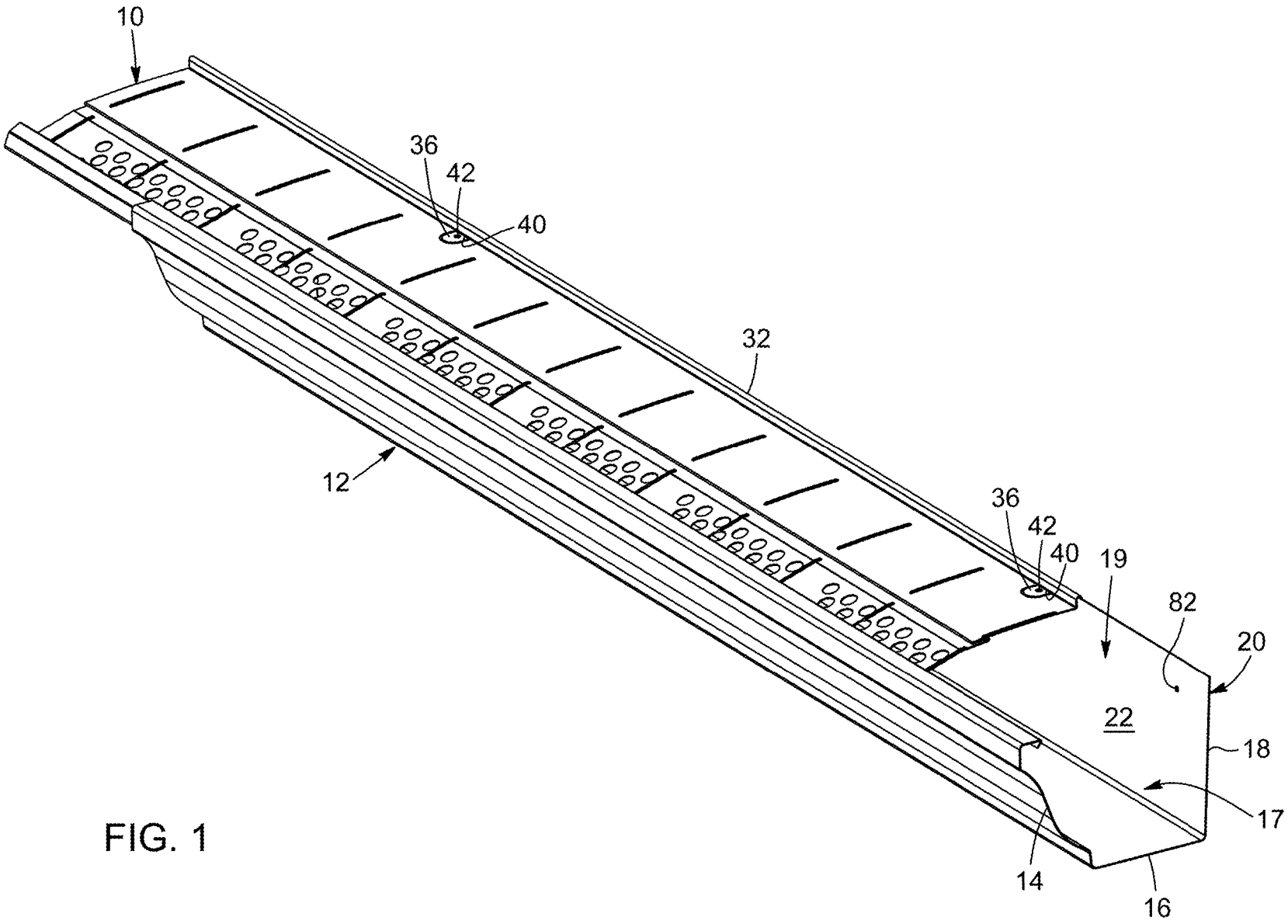
FIG. 1 is a side perspective view of a section of a gutter with a gutter cover engaged therewith to cover an open top of the gutter.

In the following description are described various embodiments related to a gutter-cover for use in combination with a rain gutter (hereinafter referred to as a gutter). As will be readily understood by one skilled in the art, the gutter cover and the gutter according to the embodiments presented herein and equivalents thereto may be provided separately or in combination. In some embodiments, a gutter cover configured to be used with a gutter is provided. Such combination may or may not be commercialized as a kit to be assembled. In another embodiment, a gutter cover that may be commercialized as a standalone component to fit over a traditional gutter is provided.

Although the embodiments of the gutter cover and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation therebetween, as well as other suitable geometrical configurations, may be used for the gutter cover, as will be briefly explained herein and as can be easily inferred herefrom by a person skilled in the art.

Moreover, it will be appreciated that positional descriptions such as “downwardly”, “rearwardly”, “frontwardly”, “upper”, “outer” and the like should be taken in the context of the figures only and should not be considered limiting.

Having discussed the general context of the cover for use in combination with a gutter, optional embodiments will be discussed further hereinbelow. The embodiments according to the following description are given for exemplification purposes only.

Referring to FIGS. 1 to 12, a gutter cover (10) (which can also be referred to as a gutter guard) in combination with a gutter (12) is shown. In an embodiment, the gutter cover (10) is designed to be preassembled with the gutter (12) and then, secured to a supporting surface, such as a wall, as an assembly. The gutter (12) and the cover (10) may be made of metal, such as and without being limitative, aluminium, plastic or other suitable material.

The gutter (12) includes a front wall (14) and a rear wall (18), both front and rear walls (14, 18) extending substantially upwardly from a bottom wall (16) to define a trough (17) having an open top (19).

In the embodiments shown, the rear wall (18) of the gutter (12) is substantially straight and includes an outer side (20) superposable to a supporting surface (not shown), such as a wall and the like, and an inner side (22) facing the trough (17).

Still referring to FIGS. 1 to 12, the gutter cover (10), engageable with the gutter (12) to at least partially cover the open top (19) and close the trough (17), includes a front portion (30), a central portion (34), and a rear portion (32). The front portion (30) and the rear portion (32) are respectively engageable with the front wall (14) and the rear wall (18) of the gutter (12). The central portion (34) extends between the front portion (30) and the rear portion (32) and substantially covers the trough (17).

When engaged together, the cover (10) closes the open top (19) of the gutter (12) and substantially prevents debris accumulation into the trough (17).

Particularly, at least a portion of the central portion (34) extending between the front portion (30) and the rear portion (32) is perforated to allow water to accumulate and run through the trough (17) while providing protection against leaves and other sorts of debris from blocking the gutter (12).

In the embodiments shown, the cover (10) is a single piece in that it is made of a single plate bent to define the different sections and features. However, it is appreciated that, in an alternative embodiment, it can be made of a plurality of components secured together.

According to a particular embodiment shown in FIGS. 1 to 4, the central portion (34) of the cover (10) comprises a plurality of spaced-apart deflectable fastener-receiving flaps (36) (hereinafter deflectable flaps or flaps), provided adjacent to the rear portion (32) of the gutter cover (10). Each one of the deflectable flaps (36) is hingedly connected to the rear portion (32), at a junction (38) with the central portion (34). The hinge connection (40) allows the deflectable flap (36) to be deflected from a closed configuration, wherein the deflectable flap (36) extends substantially in a same plane than an adjacent section of the central portion (34), to an open (operative) configuration. Particularly, in the operative configuration, the deflectable flap (36) is oriented substantially downward (arrow A) and extends into the through (17). To configure the deflectable flap (36) between the closed and the operative configurations, the deflectable flap (36) is pivoted downwardly into the trough (17) about the hinged connection (40). In the operative connection, the deflectable flap (36) defines an oblique angle with the adjacent section of the central portion (34) and the rear wall (18) of the gutter (12).

In a non-limitative embodiment, the deflectable flaps (36) are substantially evenly spaced-apart along a longitudinal axis of the gutter cover (10).

Particularly, the deflectable flap (36) may be of any shape inasmuch as it is large enough to receive a mechanical fastener. In the embodiment shown, which is non-limitative, the deflectable flap is semi-circular or U-shaped, and connected to the rear portion (32) and aligned therewith by the hinge (40).

More particularly, the deflectable flap (36) can be precut in the central portion (34) of the cover (10), and retained to the central portion only by its hinge (40). Alternatively, the shape of the deflectable flap (36) is pre-defined with small puncture lines (or weakness lines) that are easily torn and/or detached upon pressure and/or insertion of the mechanical fastener to allow downward deflection of the flap (36) into the trough (arrow A). Still alternatively, deflectable flap (36) can be precut in the central portion (34) of the cover (10), and retained to the central portion by its hinge (40) and one or few retaining bridges extending between the flap (36) and the surrounding central portion (34) of the cover (10).

Figure 2:
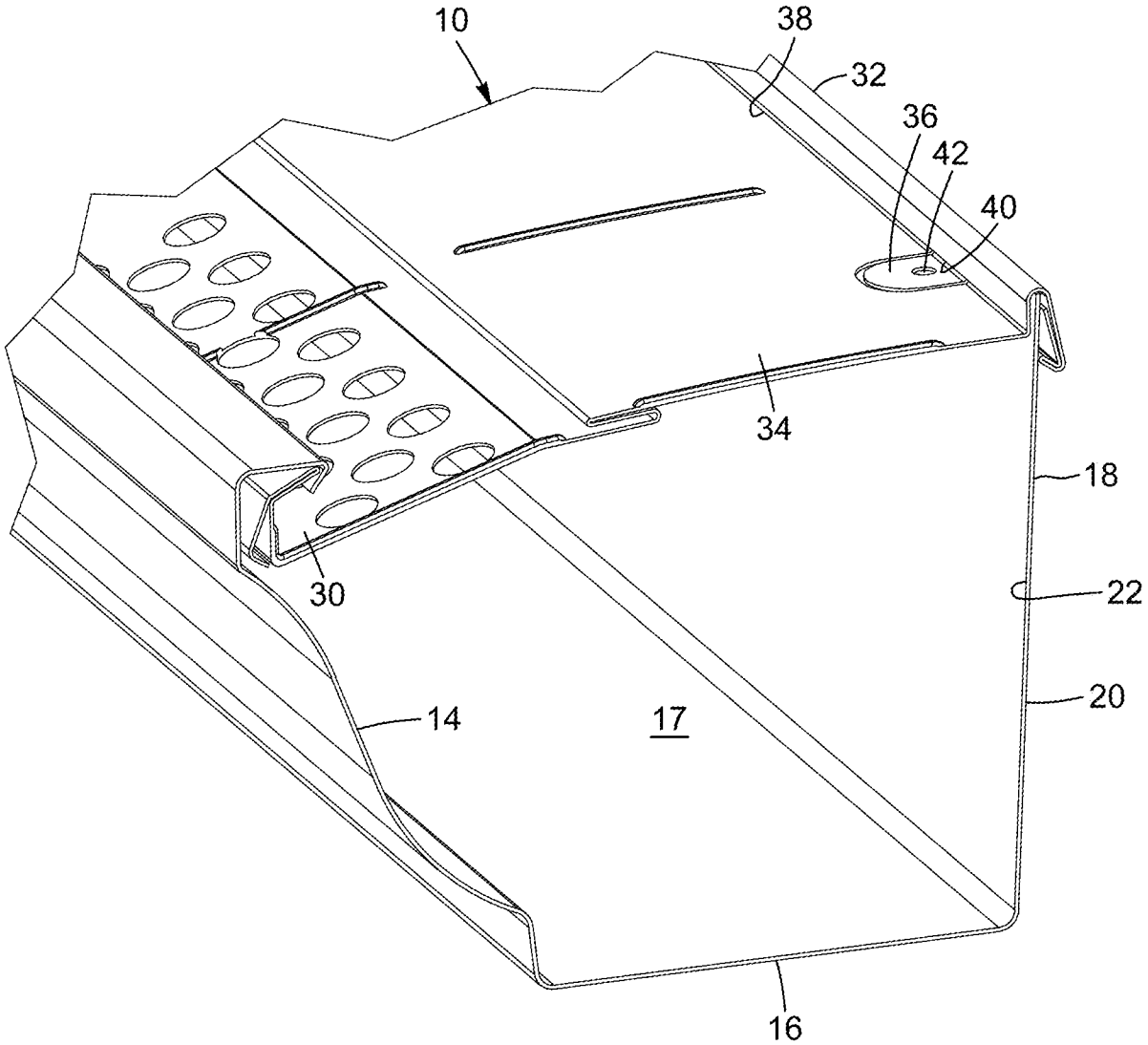
FIG. 2 is a side perspective view, enlarged, of the gutter cover and the gutter of FIG. 1, where the gutter cover is now translated towards the right to cover completely the gutter.

In a non-limitative embodiment, as shown in FIG. 2, the deflectable flap (36) comprises a preformed aperture (42) for receiving a mechanical fastener therein.

Particularly, the fastener-receiving aperture (42) is substantially centrally positioned with respect to the deflectable flap (36) to receive any type of mechanical fastener, such as a screw or a nail. For securing the gutter assembly, a mechanical fastener is inserted in the aperture (42) of the flap (36) and into the rear wall (18) of the gutter (12) to secure the gutter assembly to the supporting surface (not shown). In a non-limiting embodiment, the rear wall (18) may already comprise a plurality of preformed apertures (82) aligned with the flaps (36), thus allowing easier insertion of the mechanical fastener through the gutter's rear wall (18) and ultimately to the supporting surface.

Figure 3:
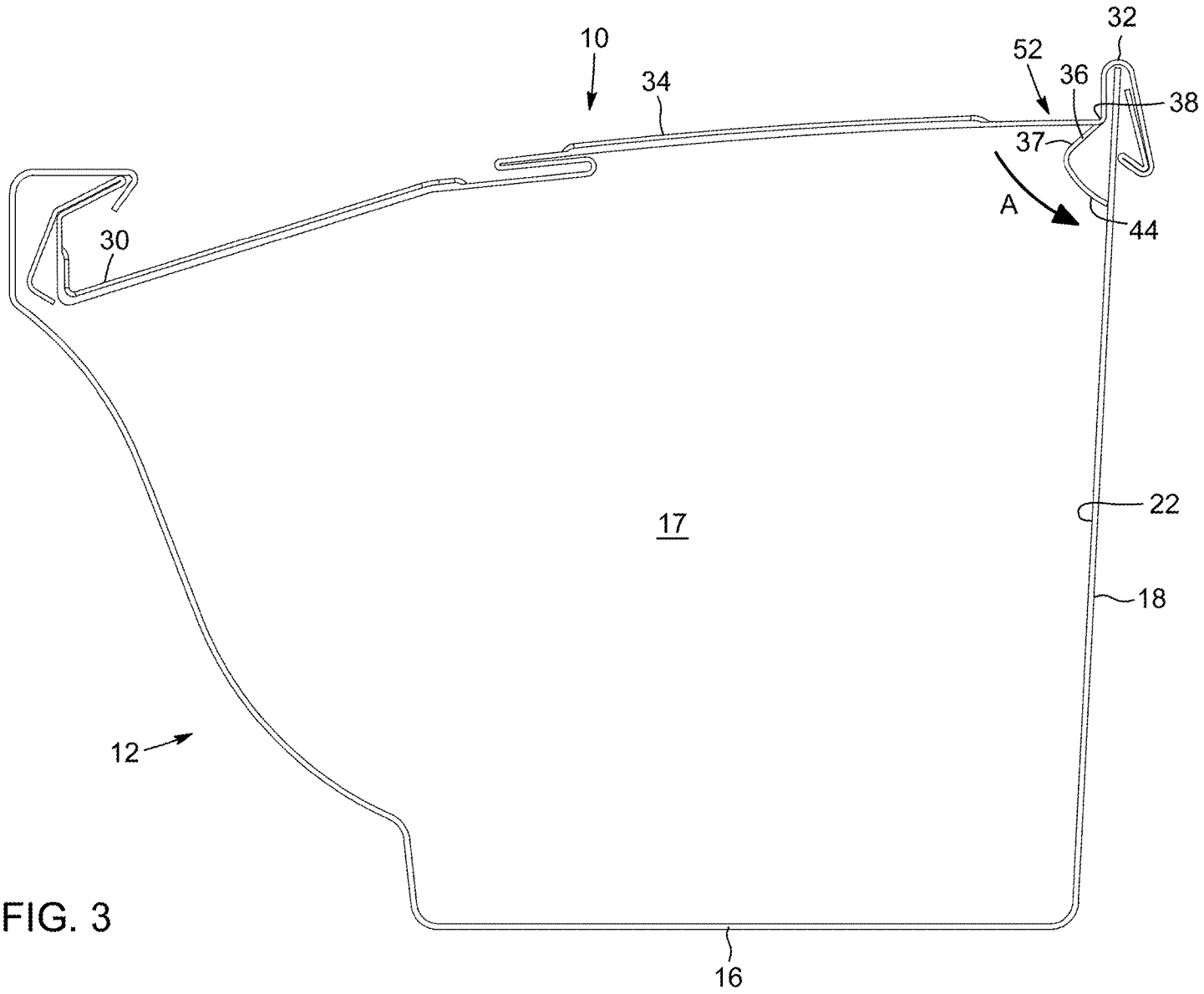
FIG. 3 is a side elevation view of the gutter cover and the gutter of FIG. 2, showing a deflectable flap in an operative (deflected downwardly) configuration.

In accordance with an embodiment shown FIGS. 3 and 4, the flap (36) deflects below the adjacent section of the central portion (34) upon downward pressure or insertion of the fastener, and forces positioning of the fastener at an oblique angle with respect to the adjacent section of the central portion (34) and the rear wall (18), i.e. between the central portion (34) and the rear wall (18). Upon deflection of the deflectable flap (36), an opening (52) is defined in the central portion (34) of the gutter cover (10), adjacent to the rear portion (32).

Optionally, according to this embodiment, the flap (36) may further comprise an abutment (44) sized to abut against the inner face (22) of the rear wall (18) upon deflection of the flap (arrow A). This abutment (44) may be preferably sized to stop the flap's deflection around mid-course downward, thereby forcing insertion of the fastener (54) at an oblique angle with respect to the adjacent section of the central portion (34) and the rear wall (18), i.e. between the central portion (34) and the rear wall (18).

Figure 4:
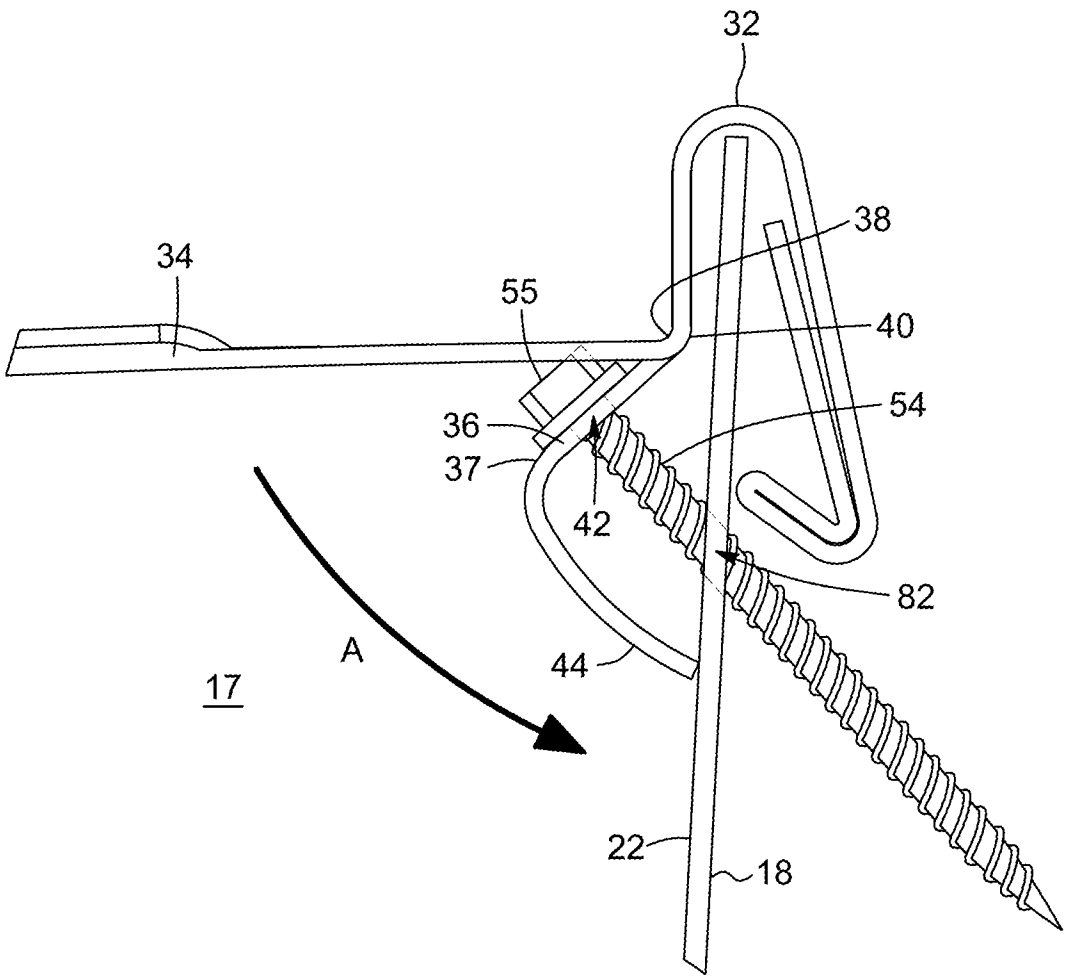
FIG. 4 is a side elevation view, enlarged, of the gutter cover and the gutter of FIG. 3, with a mechanical fastener inserted in the deflectable flap and the rear wall of the gutter for securing the gutter assembly to a supporting surface.

Particularly, as will be well recognized by a person skilled in the art, and as shown in FIG. 4, the size, shape and positions of the flap (36), hinge (40), flap aperture (42), rear wall apertures (82) and fastener size and length are calculated such that a head (55) of the fastener (54), when inserted in the flap (36), rear wall (18) and supporting surface, is substantially located in the opening (52) formed in the central portion (34) after deflection of the flap (36) in its operative configuration. The fastener head (55) thus being substantially aligned with or protruding from the adjacent section of the central portion (34), substantially prevents further entry of debris into the gutter trough (17). Optionally, the head (55) of the fastener (54) abuts against a face (37) of the flap (36), as illustrated in FIG. 4.

According to an alternative embodiment shown in FIGS. 5 to 8, the rear portion (32) of the cover (10) comprises a fastener abutment (50) extending in the trough (17), below an adjacent section of the central portion (34) of the cover (10).

Figure 5:
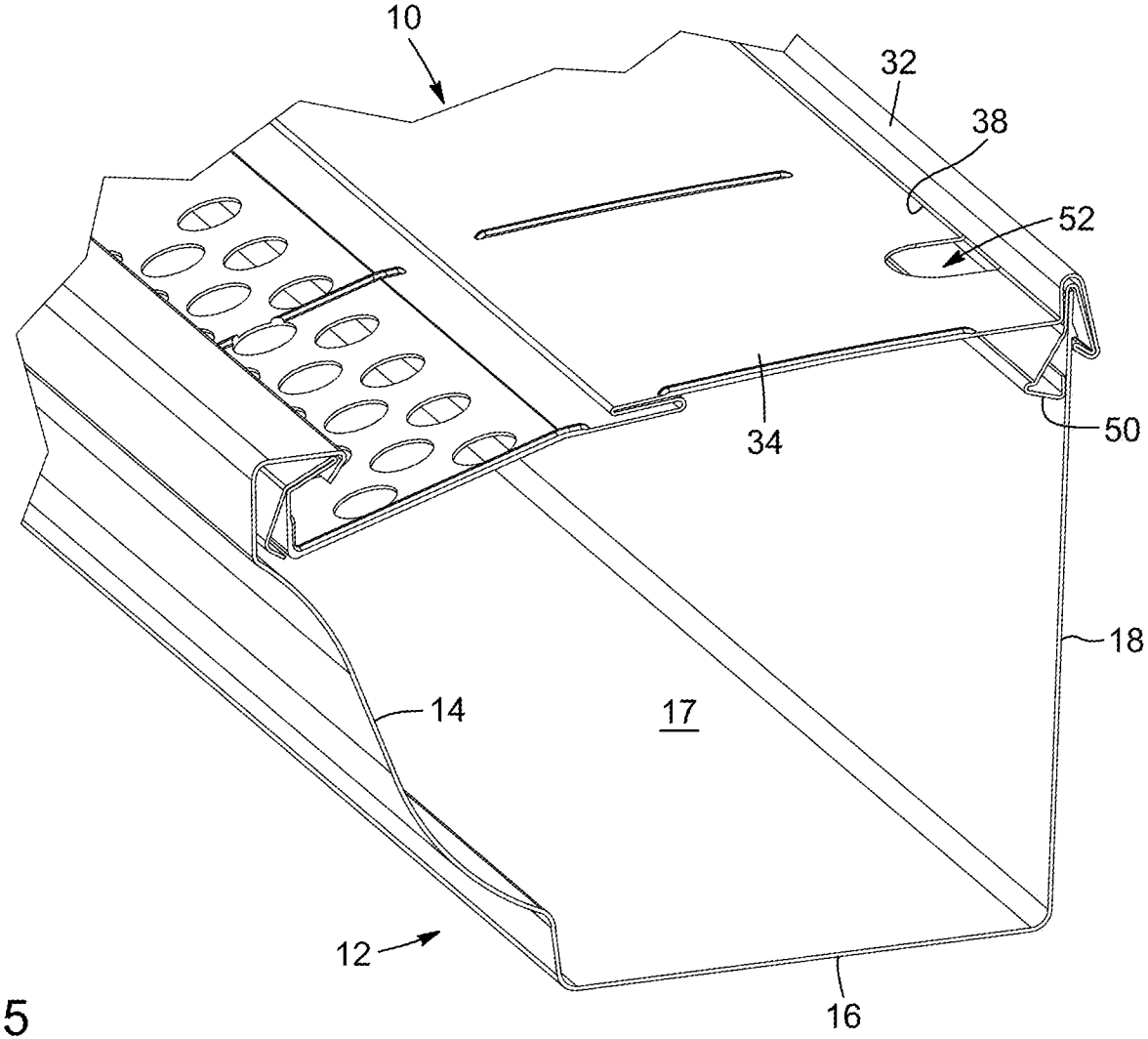
FIG. 5 is a side perspective view, enlarged, of another embodiment of the gutter and the gutter cover in accordance with an embodiment.
Figure 6:
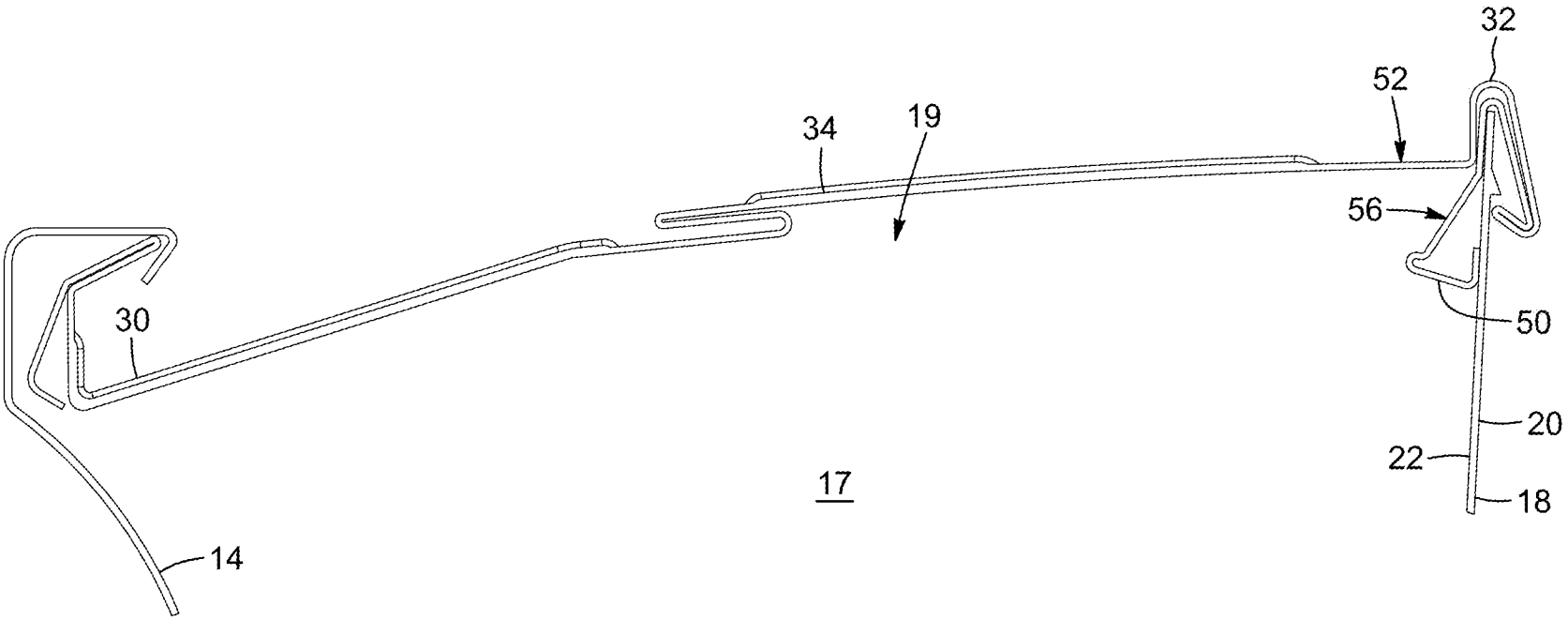
FIG. 6 is a side elevation view of the gutter cover and the gutter of FIG. 5.

The central portion (34) of the cover (10) may comprise deflectable flaps (36) as shown earlier or in FIGS. 9 to12, or as illustrated in FIG. 5, simply comprise openings (52) large enough to allow insertion of a mechanical fastener (54) therethrough.

Particularly, the fastener abutment (50) and the rear wall (18) of the gutter (12) are configured to receive a mechanical fastener (54) therein to secure the gutter, including the gutter cover (10), to the supporting surface (such as a wall).

The fastener abutment (50) defines an oblique angle with the rear wall (18) of the gutter (12), when the gutter cover (10) is engaged with the gutter (12) to at least partially cover the open top (19). The fastener abutment (50) provides an angled surface for the fastener, such that the fastener (54) is maintained obliquely with respect to the rear wall (18) of the gutter upon insertion therethrough.

Particularly, the fastener abutment (50) extends longitudinally continuously below the central portion (34) of the cover (10), adjacent to a junction with the rear portion (32). As will be readily envisioned by persons of skill in the art, the fastener abutment (50) may be embodied as a plurality of spaced-apart small sections positioned under each opening (52), or as a single longitudinal member covering the whole length of the gutter cover (10).

In an embodiment, the fastener abutment (50) comprises a plurality of apertures (56), positioned below and each one being aligned with a respective one of the central portion's openings (52), such that the fastener inserted in the central portion's openings (52) or deflectable flaps (36) and the fastener abutment aperture (56), is also inserted in the rear wall (18) in an oblique angle to further secure the gutter assembly to the supporting surface.

Particularly, the fastener abutment (50) may be positioned at any angle with respect to the rear wall (18), inasmuch as it forces insertion of the fastener obliquely therein.

Figure 8:
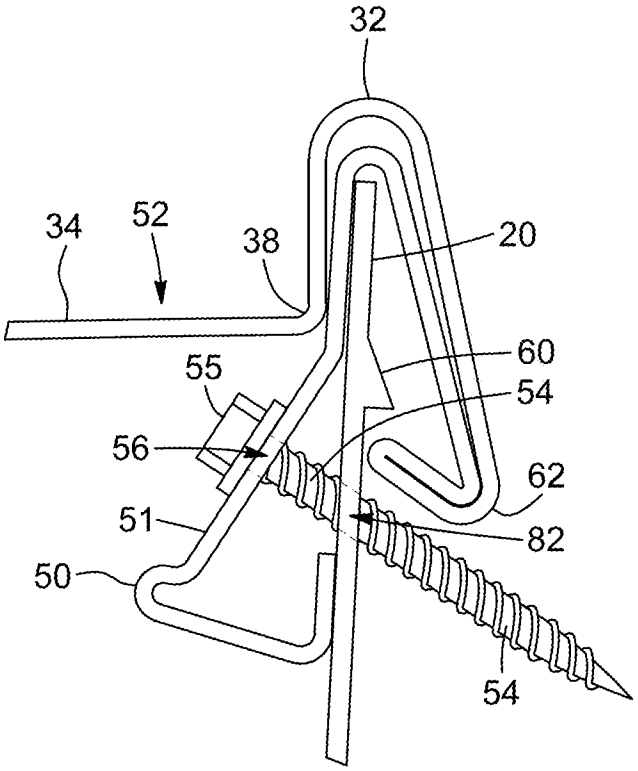
FIG. 8 is a side elevation view, enlarged, of the fastener abutment of FIG. 6, when engaged with the gutter and secured to the supporting surface with a mechanical fastener.
Figure 7:
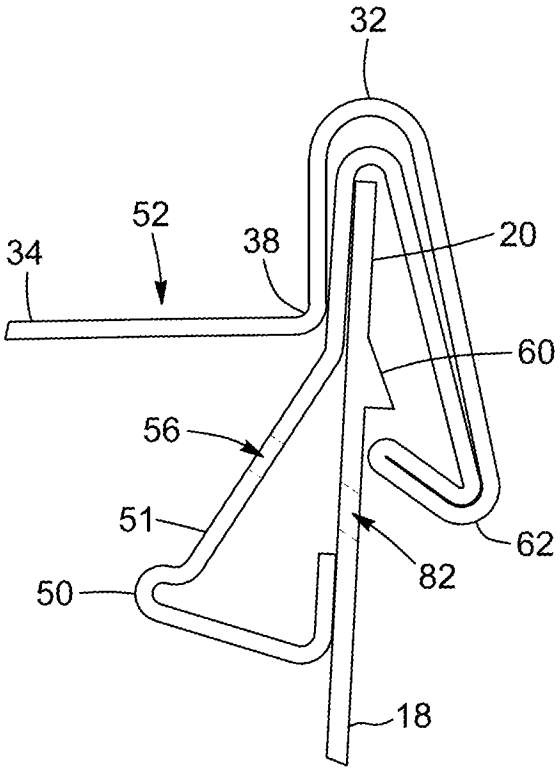
FIG. 7 is a side elevation view, enlarged, of a fastener abutment of the gutter cover according to the embodiment of FIG. 5.
Figure 9:
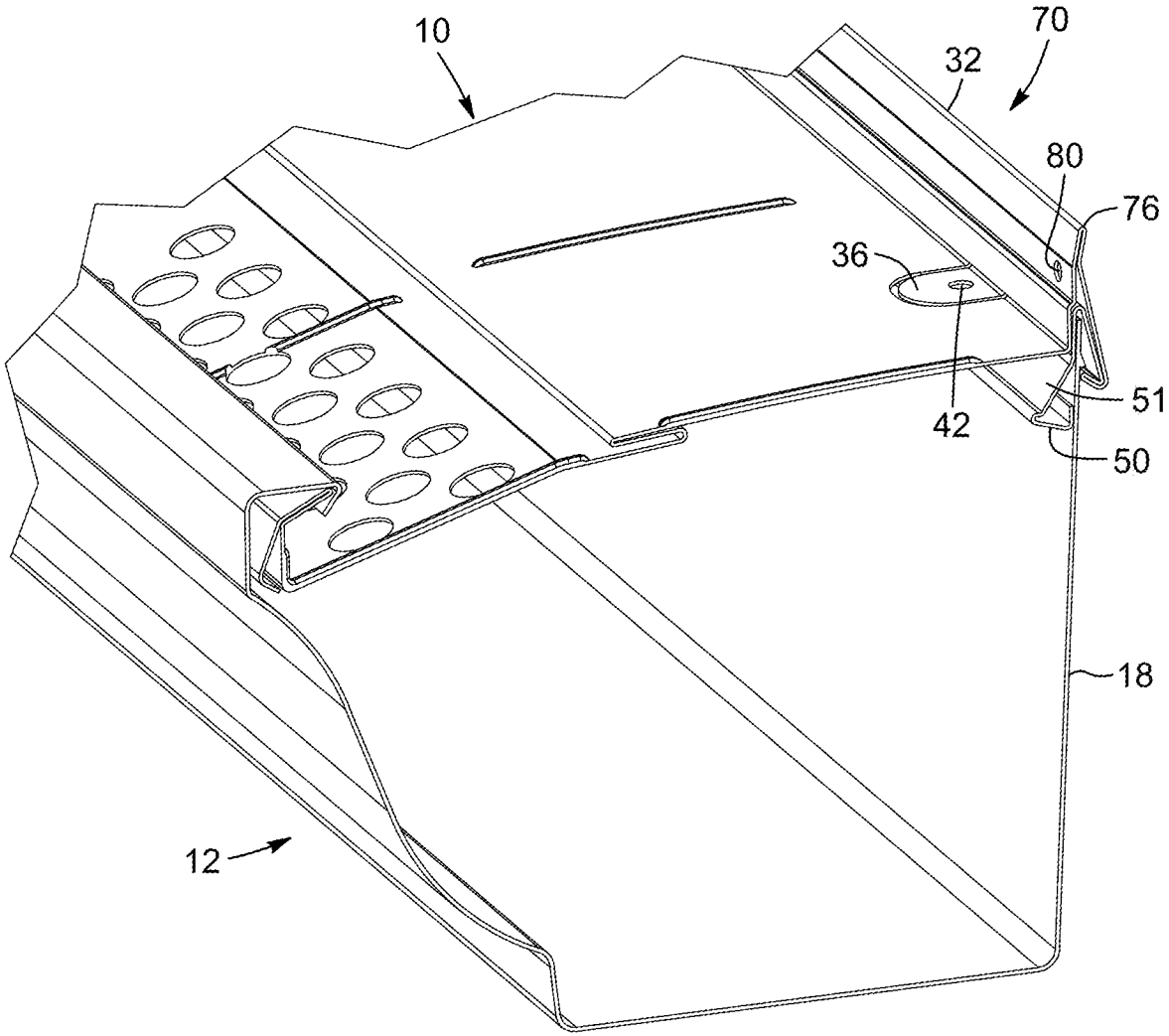
FIG. 9 is a side perspective view of the gutter cover and the gutter in accordance with another embodiment, wherein the gutter cover includes a combination of a deflectable flap and a fastener abutment.
Figure 10:
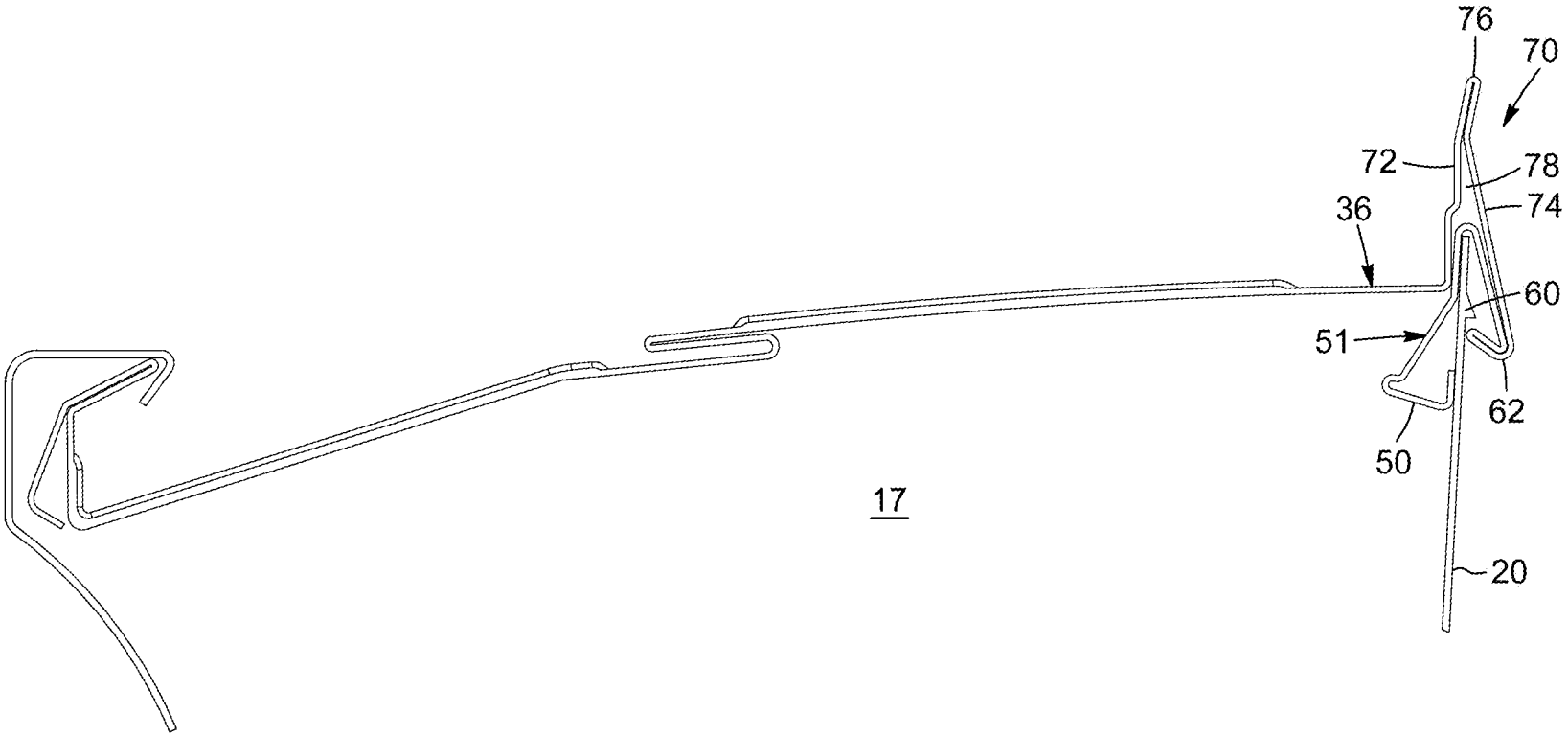
FIG. 10 is a side elevation view of the gutter-cover and the gutter of FIG. 9.

Optionally, as illustrated in FIG. 8, the head (55) of the mechanical fastener (54) abuts against a face (51) of the fastener abutment (50).

Also, optionally, at least a portion of the head (55) of the mechanical fastener (54) is positioned in and/or close of the opening (52) to substantially prevents further entry of debris into the gutter trough (17).

In a particular embodiment, still referring to FIGS. 5-8, the rear wall (18) of the gutter (12) includes a plurality of spaced-apart crimps (60) protruding outwardly from the outer face (20) of the rear wall (18) of the gutter, or any other types of protuberance or equivalent structures that would allow a hook to attach thereon. The crimps (60) may be provided at a substantially constant height with respect to the top edge of the rear portion (32). The downward portion of the rear portion (32) of the cover (10) is provided with a hookable portion (62) or a hookable-member. In some scenarios, the hookable portion (62) can include a plurality of individual space-apart hooks.

Now referring to FIGS. 9 to 12, the rear portion (32) of the cover (10) can include a gutter wall-engaging ridge (70), or gutter wall-contacting ridge. The gutter wall-engaging ridge (70) includes rear segments (74) provided at a lower end with a hook (62) and front segments (72) including the fastener abutment (50). The front and rear segments (72, 74) are connected by loops 76 and define a channel (78) inbetween, open at a lower end, in which an top edge of the rear wall (18) of the gutter (12) is inserted upon engagement of the gutter cover (10) with the gutter (12). When the gutter cover (10) and the gutter (12) are engaged together, the rear segment (74) extends rearwardly of the rear wall (18) of the gutter (12) while the front segment (72) extends forwardly of the rear wall (18) of the gutter (1210), into the trough (17). The hook (62) is engaged with the crimps (60) provided along the rear wall (18) of the gutter (12) and prevent vertical disengagement of the gutter cover (10) from the gutter (12).

Optionally, as shown on FIGS. 9 to 12, the ridge (70) optionally includes fastener holes (80) through which fasteners such as screw or nails can be received to fix an assembly including the gutter (12) and the gutter-cover (10) to a supporting structure, such as a wall.

Optionally, the head (55) of the fastener (54) abuts against a face (71) of the wall-engaging ridge (70).

Figure 12:
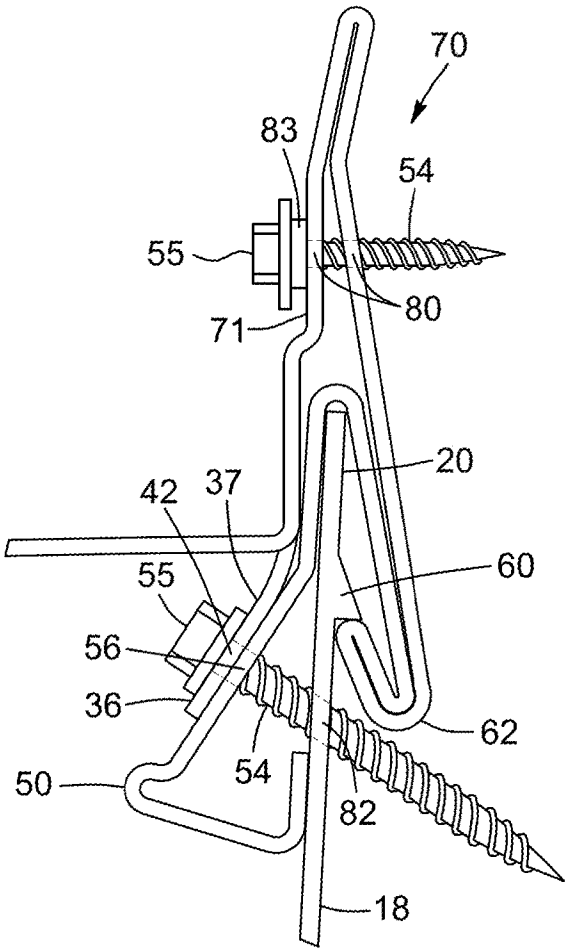
FIG. 12 is a side elevation view, enlarged, of the gutter-cover including the combination of deflectable flap and fastener abutment of FIG. 9, when engaged with the gutter and secured to the supporting surface with two mechanical fasteners.
Figure 11:
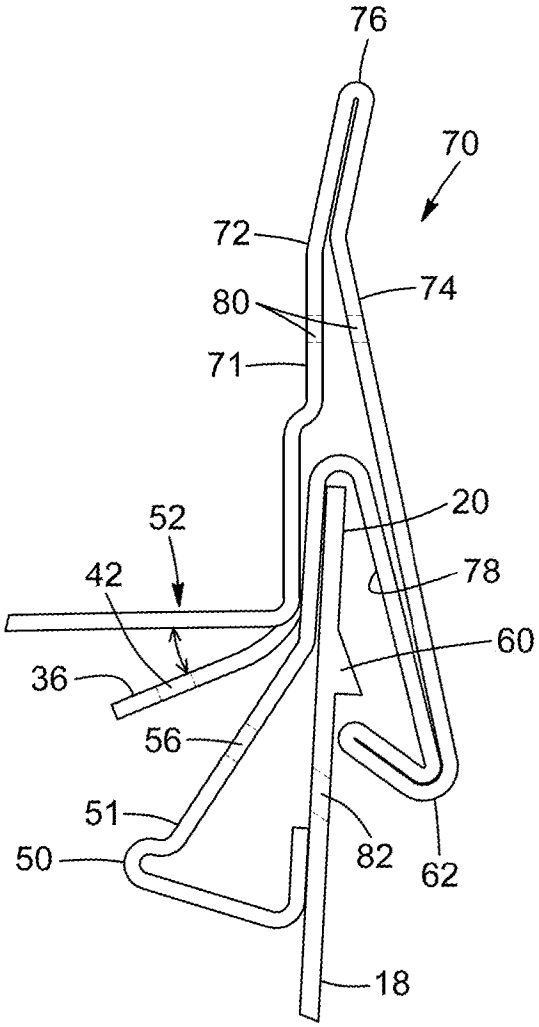
FIG. 11 is a side elevation view, enlarged, of the gutter cover including the combination of deflectable flap and fastener abutment of the gutter-cover according to the embodiment of FIG. 9.

As mentioned above, the gutter-cover (10) is engaged with the gutter (12) to form an assembly prior to securing the assembly to a supporting structure. Engagement between the rear portion (32) of the gutter-cover (10) with the rear wall (18) of the gutter (12) may also be provided through engagement of the hookable portion (62) with the crimps (60) protruding outwardly from the rear wall (18) of the gutter (12), as shown in FIGS. 8 and 12.

It is appreciated that, in an alternative embodiment (not shown), the rear portion (32) of the gutter-cover (10) may also include other varieties of connectors configured and positioned to connect the gutter-cover (10) to the gutter (12).

Following engagement between the front portion (30) and the rear portion (32) of the gutter-cover (10) and respectively the front wall (14) and the rear wall (18) of the gutter (12), the whole assembly is supported by passing fasteners through the deflectable flap (36) and/or the fastener abutment (50) and the rear wall (18) of the gutter (12) to achieve an oblique angle, and then securely attaching the gutter assembly to the supporting surface. Hence, the gutter cover (10) is engaged with the gutter (12), and the gutter assembly can be fixed to the supporting surface with a single row, of obliquely-angled fasteners. Optionally, a second row of fasteners can be fixed in the fastener holes (80) provided in the wall-engaging ridge (70).

In this specification, the term "mechanical fastener" is intended to mean any mechanical device that secures the gutter to the supporting wall. In an embodiment, the fasteners can be mechanical fasteners, such as nails or screws, extending sequentially through the deflectable flap (36) and/or the fastener abutment (50) and the rear wall (18) of the gutter (12), and ultimately, the supporting wall.

Optionally, as illustrated in FIG. 12, the head (55) of the mechanical fastener (54) abuts against a face (51) of the flap (36) and said flap 36 abuts against the face (51) of fastener abutment (50).

Also, optionally, between the head (55) and a corresponding face (37), (51) or (71), a washer (83) may be provided. Said washer (83) can be made of any appropriate material. Optionally, the washer (83) may be made of elastomeric material to further prevent possible water infiltrations.

Also, optionally, as illustrated in FIG. 12, at least a portion of the head (55) of the mechanical fastener (54) is positioned in and/or close of the opening (52) to substantially prevents further entry of debris into the gutter trough (17).

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A gutter cover engageable with a gutter superposable to a supporting surface, the gutter comprising a front wall, a bottom wall and a rear wall defining a trough with an open top, the gutter cover being engageable with the gutter to substantially cover the open top, the gutter cover being a one-piece gutter cover consisting of:

a front portion engageable with the front wall of the gutter, a rear portion engageable with the rear wall of the gutter, and a central portion which is perforated and extends between the front portion and the rear portion, the central portion a plurality of spaced-apart deflectable fastener receiving flaps hingedly connected at a junction with the rear portion, at least one of the plurality of spaced-apart deflectable fastener receiving flaps being downwardly pivotable into the trough, below the adjacent section of the central portion, upon insertion of a mechanical fastener therein and into the rear wall of the gutter to secure the gutter cover to the gutter and the gutter to the supporting surface.

2. The gutter cover of claim 1, wherein the rear portion is further provided with a fastener abutment forming an integral part of the one-piece gutter cover, extending in the trough, below the central portion, and defining an oblique angle with the rear wall of the gutter, when the gutter cover is engaged with the gutter to substantially cover the open top, the fastener abutment being configured to receive the mechanical fastener, the fastener abutment maintaining an oblique angle with the rear wall of the gutter upon insertion of the mechanical fastener therethrough.

3. The gutter cover of claim 2, wherein the fastener abutment extends longitudinally continuously along the gutter cover, below the central portion thereof.

4. The gutter cover of claim 2, wherein the at least one of the plurality of spaced-apart deflectable fastener-receiving flaps abuts against the fastener abutment when deflected into the trough.

5. The gutter cover of claim 2, wherein the fastener abutment comprises a plurality of spaced-apart apertures, each one of the plurality of spaced-apart apertures being substantially aligned with a corresponding one of the at least one of the plurality of spaced-apart deflectable fastener-receiving flaps.

6. The gutter cover of claim 1, wherein the rear wall comprises an inner face, and the at least one of the plurality of spaced-apart deflectable fastener receiving flaps comprise an abutment abuttable against the inner face of the rear wall.

7. The gutter cover of claim 1, wherein the plurality of spaced-apart deflectable fastener-receiving flaps are longitudinally aligned with the rear portion of the gutter cover.

8. The gutter cover of claim 1, wherein the plurality of spaced-apart deflectable fastener-receiving flaps are deflectable from a closed configuration wherein the plurality of spaced-apart deflectable fastener-receiving flaps extend substantially in a same plane as an adjacent section of the central portion of the gutter cover to an operative configuration wherein the plurality of spaced-apart deflectable fastener-receiving flaps are located into the trough of the gutter, below the adjacent section of the central portion of the gutter cover.

9. The gutter cover of claim 8, wherein in the operative configuration, the plurality of spaced-apart deflectable fastener-receiving flaps define an oblique angle with the adjacent section of the central portion of the gutter cover.

10. The gutter cover of claim 1, wherein the junction of each one of the plurality of spaced-apart deflectable fastener-receiving flaps with the rear portion are substantially linear and aligned.

11. The gutter cover of claim 1, wherein each one of the plurality of spaced-apart deflectable fastener-receiving flaps is precut in the central portion of the gutter cover.

12. The gutter cover of claim 1, wherein each one of the plurality of spaced-apart deflectable fastener-receiving flaps is pre-defined by weakness lines in the central portion of the gutter cover.

13. The gutter cover of claim 1, wherein each one of the plurality of spaced-apart deflectable fastener-receiving flaps comprises a fastener aperture.

14. The gutter cover of claim 13, wherein the fastener aperture is positioned substantially centrally with respect to the respective one of the plurality of spaced-apart deflectable fastener-receiving flaps.

* * * * *